US008403474B2

(12) United States Patent
Taniguchi

(10) Patent No.: US 8,403,474 B2
(45) Date of Patent: Mar. 26, 2013

(54) PRETREATMENT AGENT FOR INK JET INK, CLOTH TREATED BY PRETREATMENT AGENT, AND INK JET PRINTING METHOD

(75) Inventor: Makoto Taniguchi, Nagano-ken (JP)

(73) Assignee: Seiko Epson Corporation (JP)

( * ) Notice: Subject to any disclaimer, the term of this patent is extended or adjusted under 35 U.S.C. 154(b) by 1241 days.

(21) Appl. No.: 11/725,035

(22) Filed: Mar. 16, 2007

(65) Prior Publication Data

US 2007/0216741 A1 Sep. 20, 2007

(30) Foreign Application Priority Data

Mar. 17, 2006 (JP) ..... 2006-074107

(51) Int. Cl.
*C09D 11/02* (2006.01)

(52) U.S. Cl. ..... 347/100; 106/31.13

(58) Field of Classification Search ..... 347/100; 106/31.13

See application file for complete search history.

(56) References Cited

U.S. PATENT DOCUMENTS

| | | | | |
|---|---|---|---|---|
| 5,137,773 | A * | 8/1992 | Malhotra | 428/32.14 |
| 5,302,249 | A * | 4/1994 | Malhotra et al. | 162/135 |
| 5,631,684 | A * | 5/1997 | Takaide et al. | 347/100 |
| 5,847,740 | A * | 12/1998 | Yamamoto et al. | 347/106 |
| 6,447,592 | B1 | 9/2002 | Taniguchi | |
| 2003/0095169 | A1 * | 5/2003 | Ito et al. | 347/100 |
| 2005/0036018 | A1 * | 2/2005 | Yanagihara et al. | 347/100 |
| 2005/0193499 | A1 * | 9/2005 | Chevli | 8/115.51 |

FOREIGN PATENT DOCUMENTS

| | | | |
|---|---|---|---|
| EP | 1010802 | A | 6/2000 |
| EP | 1035248 | A | 9/2000 |
| JP | 60-215881 | A | 10/1985 |
| JP | 63-31594 | | 6/1988 |
| JP | 08-259832 | A | 10/1996 |
| JP | 10-183481 | A | 7/1998 |
| JP | 2000-327976 | A | 11/2000 |
| JP | 2004-143621 | A | 5/2004 |
| JP | 2004-162247 | A | 6/2004 |
| JP | 2004-189795 | A | 7/2004 |
| JP | 2004-225189 | A | 8/2004 |
| JP | 2005-262562 | A | 9/2005 |
| WO | 99-55955 | A | 11/1999 |
| WO | 2005-88006 | A | 9/2005 |

OTHER PUBLICATIONS

English Abstract of Japanese Application 60-215881 A Issued Oct. 29, 1985.
English Abstract of Japanese Application 63-31594 A Issued Jun. 24, 1988.
English Abstract of Japanese Application 10-183481 A Issued Jul. 14, 1998.
English Abstract of Japanese Application 2004-143621 A Issued May 20, 2004.
English Abstract of Japanese Application 2004-162247 A Issued Jun. 10, 2004.
English Abstract of Japanese Application 2004-225189 A Issued Aug. 12, 2004.
English Abstract of Japanese Application 2005-262562 A Issued Sep. 29, 2005.
English Abstract of Japanese Application 08-259832 A Issued Oct. 8, 1996.
English Abstract of Japanese Application 2004-189795 A Issued Jul. 8, 2004.

* cited by examiner

*Primary Examiner* — Laura Martin
(74) *Attorney, Agent, or Firm* — Harness, Dickey & Pierce, P.L.C.

(57) ABSTRACT

A pretreatment agent for ink jet printing employing an acid dye includes hydroxyethyl cellulose; ammonium salt; a hydrotropic agent; and water, wherein the content of the hydroxyethyl cellulose is in the range of 1 to 5 wt % and the content of ammonium salt is in the range of 1 to 6 wt %.

11 Claims, No Drawings

PRETREATMENT AGENT FOR INK JET INK, CLOTH TREATED BY PRETREATMENT AGENT, AND INK JET PRINTING METHOD

BACKGROUND

1. Technical Field

The present invention relates to a pretreatment agent for ink jet ink. The pretreatment agent according to the invention is used in combination with the ink jet ink containing an acid dye, thereby reducing smearing and allowing a high-quality image having a high coloring property to be obtained.

2. Related Art

In the related art, examples of a method of printing an image onto cloth includes a screen printing method, a roller printing method, a rotary screen printing method, and a transfer printing method. However, since it is necessary to prepare an expensive screen frame, an engraving roller, or a transfer paper for every change in image design in the methods, the methods are not suitable for limited production of diverse products in terms of cost and cannot cope with diversification of fashion quickly.

To solve the problem of the known printing methods, a technology has been developed in which a sample copy is read by a scanner, image processing is performed by a computer, and the resultant image is printed using an ink jet printing method. However, since the ink jet printing method has been developed as a technology using paper as a recording medium, smearing was marked and vividness was deteriorated. The reason is that since cloth has a fiber structure or a fabric structure having directionality and voids larger than those of paper, ink smears into the cloth in longitudinal and horizontal directions, whereby it is difficult to obtain a vivid image. For the ink jet printing method, since ink droplets are ejected from an ink head to the recording medium, it is theoretically impossible to just apply high-viscosity ink used in the known printing method and it is necessary to reduce a viscosity to a considerable low level to prevent the ink head from becoming clogged.

Therefore, for an ink jet printing method, a technology has been developed in which, as a printing paste used in the known printing method, a printing paste having two constituents such as a high-viscosity pretreatment agent and low-viscosity ink is used, the cloth being first subjected to padding processing with the pretreatment agent, and then ink being ejected from a printer head to the pretreated cloth. For an ink jet printing method, a technology has been also proposed of which an object is to prevent smearing by providing a particular constituent in the treatment agent, thereby allowing a vivid image to be obtained.

For example, in JP-B-63-31594, an ink jet printing method is proposed in which smearing is prevented using a pretreated cloth previously treated with a dye holding agent, thereby enabling a vivid image to be obtained. JP-B-63-31594 discloses that the dye holding agent includes a water-soluble polymer (i.e., a natural water-soluble polymer or a synthetic water-soluble polymer), water-soluble salt, and a water-insoluble inorganic particle. However, JP-A-10-183481 discloses that since large fluctuations in coloring occur due to differences between batches of a cloth material and differences in temperature-humidity conditions between storage locations or processing sites for industrial production, there is a problem with color reproducibility and since uneven dyeing occurs, there is a problem in obtaining a constant dying property in the method disclosed in JP-B-63-31594.

The present inventor has studied a pretreatment agent capable of being used to obtain a vivid image to be obtained by preventing smearing and achieving a high coloring property and has found that a smearing-resistant effect is markedly improved, thereby enabling a very vivid high-quality image having a high coloring property to be obtained by using hydroxyethyl cellulose as a water-soluble resin constituent to be obtained.

However, that incorporation of a water-soluble polymer compound such as hydroxyethyl cellulose into a pretreatment agent has already been proposed in the past. For example, in JP-B-63-31594, a dye holding agent incorporated into the pretreatment agent includes a natural water-soluble polymer such as a water-soluble polymer (i.e., a natural water-soluble polymer or a synthetic water-soluble polymer), water-soluble salt, and a water-insoluble inorganic particle, and more specifically, includes starch (from a sweet potato, a potato, corn, or wheat), a cellulose substance (carboxyethyl cellulose, methyl cellulose, or hydroxyethyl cellulose), polysccharide (sodium alginate, gum arabic, locust bean gum, tragacanth gum, guar gum, or a tamarind seed), a protein substance (gelatine or casein), or a tannine series substance, a synthetic water-soluble polymer such as a polyvinyl alcohol series compound, a polyethylene oxide series compound, an acrylate water-soluble polymer, or a maleic anhydride series water-soluble polymer), water-soluble salt such as an alkali metal (NaCl, $Na_2SO_4$, KCl, $CH_3COONa$) or an alkali earth metal ($CaCl_2$ or $MgCl_2$), a water-soluble inorganic particle (ZnO, $SiO_2$, $CaCO_3$, $BaSO_4$, $TiO_2$, $Al(OH)_3$, $Fe_2O_2$, CaO, $K_2O$, or silicate aluminum salt), or a natural clay substance (bentonite, diatom earth, activated earth, kaolin, talc, or montmorillonite). In other words, hydroxyethyl cellulose is exemplified as one example of a cellulose series substance incorporated into the natural water-soluble polymer in JP-B-63-31594.

However, in embodiments of JP-B-63-31594, an aspect in which polyvinyl alcohol (the synthetic water-soluble polymer), $CaCl_2$ (an alkali earth metal), and bentonite (natural clay substance) are used as the dye holding agent for an acid dye is specifically disclosed, but an aspect in which the natural water-soluble polymer (for example, the cellulose series substance or the protein substance) is used as the dye holding agent for the acid dye is not specifically disclosed. Even in a comparative example, an aspect in which gelatine (the protein substance) is used as the dye holding agent for the acid dye is just disclosed. It is just disclosed that gum arabic (polysaccharide), NaCl (the alkali metal), and montmorillonite (the natural clay substance) are used as the dye holding agent for a disperse dye. In other words, in JP-B-63-31594, since a specific aspect employing the cellulose substance is not disclosed, a specific examination is not performed. In JP-B-63-31594, it is specifically disclosed that gelatine (the protein substance) incorporated into the natural water-soluble polymer compound is used as a comparative substance and is inferior in coloring property.

In contrast, as specifically described in embodiments to be described later, it is possible to obtain a high-quality image having a high coloring property without occurrence of smearing in comparison with polyvinyl alcohol, $CaCl_2$, and bentonite specifically examined in the above-mentioned embodiments of JP-B-63-31594 by using hydroxyethyl cellulose. In other words, it is possible to realize a high coloring property exceeding a limit of the coloring property in the known ink jet printing method with marked reduction (i.e., realization of a very vivid image) in occurrence of smearing by using hydroxyethyl cellulose. Hydroxyethyl cellulose is superior for obtaining a high-quality image to other representative water-soluble resin constituents such as sodium alginate or guar gum. Hydroxyethyl cellulose is superior for obtaining a high-quality image even to other cellulose substance (i.e., carboxymetyl cellulose).

SUMMARY

According to an aspect of the invention, a pretreatment agent for ink jet printing employing an acid dye includes hydroxyethyl cellulose; ammonium salt; a hydrotropic agent; and water, wherein the content of the hydroxyethyl cellulose is in the range of 1 to 5 wt % and the content of ammonium salt is in the range of 1 to 6 wt %.

In the pretreatment agent, the content of the hydrotropic agent is in the range of 5 to 15 wt %.

In the pretreatment agent, the hydrotropic agent is urea.

In the pretreatment agent, the weight-average molecular weight of hydroxyethyl cellulose is in the range of 50,000 to 500,000.

In the pretreatment agent, ammonium salt is ammonium sulfate or ammonium tartrate.

In the pretreatment agent, the pretreatment agent is used for silk or a polyamide series fiber.

According to another aspect of the invention, cloth is treated by the pretreatment agent.

In cloth, the contraction rate of the pretreatment agent is 50% or higher.

According to a further aspect of the invention, an ink jet printing method includes the step of ejecting ink jet ink containing an acid dye onto cloth pretreated by the pretreatment agent.

DESCRIPTION OF EXEMPLARY EMBODIMENTS

Pretreatment Agent

Hydroxyethyl Cellulose

A pretreatment agent according to an embodiment of the invention contains hydroxyethyl cellulose. Alkali cellulose is produced by reacting sodium hydroxide to cellulose and hydroxyl group of cellulose is substituted to hydroxyethyl group by ether binding by reacting ethylene oxide to alkali cellulose, whereby hydroxyethyl cellulose is produced.

Hydroxyethyl cellulose which can be used in the embodiment of the invention is water-soluble and DS (the average number of hydroxy groups of cellulose substituted to ethylene oxide) or MS (the average number of moles of ethylene oxide added to one unit of cellulose) is particularly not limited, but for example, DS may be in the range of 1.0 to 1.3 (13C-NMR method) and MS may be in the range of 1.8 to 2.5 (Morgan method). The weight-average molecular weight of hydroxyethyl cellulose also is not particularly limited, but the weight-average molecular weight of hydroxyethyl cellulose is preferably in the range of 50,000 to 500,000 and more preferably in the range of 100,000 to 400,000. It is possible to prevent smearing by using hydroxyethyl cellulose having a weight-average molecular weight of 50,000 or higher and it is possible to improve padding/coating characteristic and obtain a high coloring property by using hydroxyethyl cellulose having a weight-average molecular weight of 500,000 or lower.

A commercial article such as HEC Daisel SP200 or HEC Daisel SP400 (produced by DAICEL CHEMICAL INDUSTRIES, LTD.) may be used as hydroxyethyl cellulose.

In the pretreatment agent according to the embodiment of the invention, the content of hydroxyethyl cellulose is in the range of 1 to 5 wt % and preferably in the range of 1.5 to 3.5 wt % with respect to the total weight of the pretreatment agent. When the content of hydroxyethyl cellulose is set to 1 wt % or higher, it is possible to achieve a high coloring property without occurrence of smearing. When the content of hydroxyethyl cellulose is set to 5 wt % or lower, it is possible to obtain a pertinent padding viscosity.

Ammonium Salt

The pretreatment agent according to the embodiment of the invention contains ammonium salt. Ammonium salt is used as a pH moderator and promotes fixation of an acid dye. In the embodiment of the invention, arbitrary inorganic ammonium salt or organic ammonium salt can be used as long as it promotes fixation of the acid dye. Inorganic ammonium salt may include ammonium sulfate and organic ammonium salt may include ammonium tartrate. The content of ammonium salt is in the range of 1 to 6 wt % and preferably in the range of 3 to 5 wt % with respect to the total weight of the pretreatment agent. When the content of ammonium salt is set to 1 wt % or higher, it is possible to improve the coloring property by promoting fixation of the dye. Meanwhile, it is generally possible to improve the coloring property by increasing the content of ammonium salt for the ink jet printing method employing the acid dye. However, in the pretreatment agent according to the embodiment of the invention, when the content of ammonium salt is greater than 6 wt %, smearing may occur. In other words, when the content of ammonium salt is set to 6 wt %, it is possible to obtain a vivid image by effectively preventing occurrence of smearing while maintaining the high coloring property.

Hydrotropic Agent

The pretreatment agent according to the embodiment of the invention contains a hydrotropic agent. For example, alkyl urea such as urea, dimethylurea, thiourea, monomethylthiourea, or dimethylthiourea can be used as the hydrotropic agent.

The content of the hydrotropic agent is not particularly limited, but it is preferably in the range of 5 to 15 wt % and more preferably 8 to 12 wt % with respect to the total weight of the pretreatment agent. When the content of the hydrotropic agent is set to 5 wt % or higher, it is possible to improve the coloring property and when the content of the hydrotropic agent is set to 15 wt % or lower, it is possible to effectively prevent occurrence of smearing.

Water

In the pretreatment agent according to the embodiment of the invention, water is the main solvent. Ion-exchange water, ultrafiltration water, reverse osmosis water, pure water such as distilled water, or ultrapure water can be used as water. Since it is possible to prevent occurrence of mold or bacteria at the time of preserving the pretreatment for a quite while by using water sterilized by irradiating ultraviolet ray or adding hydrogen peroxide, water is very suitable.

Paste

The pretreatment agent according to the embodiment of the invention may include a paste generally used as the known paste in addition to hydroxyethyl cellulose described above. The paste, for example, may include natural gum such as guar or locust bean, starch, seaweed such as sodium alginate or sea staghorn, a plant skin such as pectic acid, cellulose derivative such as methyl cellulose, ethyl cellulose, or carboxymethyl cellulose, processing starch such as roasting starch, alpha starch, carboxymethyl starch, carboxyethyl starch, or hydroxyethyl starch, natural processing gum such as shiratsu gum or roast bean gum, al, algin derivative, synthetic paste such as polyvinyl alcohol or polyacrylate ester, or emulsion and it may include mixtures of one or two or more kinds of constituents.

The content of the paste used in addition to hydroxyethyl cellulose is not particularly limited, but it is preferably in the range of 1 wt % or lower and more preferably in the range of 0.1 to 0.5 wt % with respect to the total weight of the pretreatment agent.

Ink Jet Ink

Dye

The pretreatment agent according to the embodiment of the invention is used in combination with a ink jet ink composite containing the acid dye. The acid dye may include azo dye, anthraquinone dye, carbonium dye, nitro dye, or metal complex dye. A specific example of the acid dye is given as follows: C. I. acid yellow 1, 3, 7, 11, 17, 19, 23, 25, 29, 36, 38, 40, 42, 44, 49, 59, 61, 70, 72, 75, 76, 78, 79, 98, 99, 110, 111, 112, 114, 116, 118, 119, 127, 128, 131, 135, 141, 142, 161, 162, 163, 164, 165, 169, 207, 219, 246;

C. I. acid red 1, 6, 8, 9, 13, 14, 18, 19, 24, 26, 27, 28, 32, 35, 37, 42, 51, 52, 57, 62, 75, 77, 80, 82, 83, 85, 87, 88, 89, 92, 94, 95, 97, 106, 111, 114, 115, 117, 118, 119, 129, 130, 131, 133, 134, 138, 143, 145, 149, 154, 155, 158, 168, 180, 183, 184, 186, 194, 198, 199, 209, 211, 215, 216, 217, 219, 249, 252, 254, 256, 257, 260, 262, 265, 266, 274, 276, 282, 283, 289, 303, 317, 318, 320, 321, 322, 361;

C. I. acid blue 1, 7, 9, 15, 22, 23, 25, 27, 29, 40, 41, 43, 45, 49, 54, 59, 60, 62, 72, 74, 78, 80, 82, 83, 87, 90, 92, 93, 100, 102, 103, 104, 112, 113, 117, 120, 126, 127, 129, 130, 131, 133, 138, 140, 142, 143, 151, 154, 158, 161, 166, 167, 168, 170, 171, 175, 182, 183, 184, 185, 187, 192, 199, 203, 204, 205, 225, 229, 234, 236, 300;

C. I. acid black 1, 2, 7, 24, 26, 29, 31, 44, 48, 50, 51, 52, 58, 60, 62, 63, 64, 67, 72, 76, 77, 94, 107, 108, 109, 110, 112, 115, 118, 119, 121, 122, 131, 132, 139, 140, 155, 156, 157, 158, 159, 191, 234;

C. I. acid orange 1, 7, 8, 10, 19, 20, 24, 28, 33, 41, 43, 45, 51, 56, 63, 64, 65, 67, 74, 80, 82, 85, 86, 87, 88, 95, 122, 123, 124;

C. I. acid violet 7, 11, 15, 31, 34, 35, 41, 43, 47, 48, 49, 51, 54, 66, 68, 75, 78, 97, 106;

C. I. acid green 3, 7, 9, 12, 16, 19, 20, 25, 27, 28, 35, 36, 40, 41, 43, 44, 48, 56, 57, 60, 61, 65, 73, 75, 76, 78, 79;

C. I. acid brown 2, 4, 13, 14, 19, 20, 27, 28, 30, 31, 39, 44, 45, 46, 48, 53, 100, 101, 103, 104, 106, 160, 161, 165, 188, 224, 225, 226, 231, 232, 236, 247, 256, 257, 266, 268, 276, 277, 282, 289, 294, 295, 296, 297, 299, 300, 301, 302.

In the ink jet ink composite which can be used in combination with the pretreatment agent according to the embodiment of the invention, the content of the acid dye is not particularly limited, but it is preferably in the range of 1 to 10 wt % and more preferably in the range of 2 to 7 wt % with respect to the total weight of the ink composition. When the total content of the acid dye is set to 1 wt % or higher, it is possible to obtain sufficient printing density and when the total content of the acid dye is set to 10 wt % or lower, it is possible to secure ejection stability required for the ink jet ink composite and particularly, to prevent defective ejection.

2. Urea Series Compound

It is preferable that the ink jet ink composite which can be used in combination with the pretreatment agent according to the embodiment of the invention contains an urea series compound. The urea series compound, for example, may include alkyl urea such as urea, dimethylurea, monomethythiourea, thiourea, or dimethylthiourea, or alkylthiourea. When the ink composite according to the embodiment of the invention contains the urea series compound, it is possible to improve the solubility of the acid dye. The content of the urea series compound is not particularly limited, but it is preferably in the range of 1 to 10 wt % and more preferably in the range of 2 to 7 wt % with respect to the total weight of the ink composite. When the content of the urea series compound is set to 1 wt % or higher, it is possible to sufficiently improve the solubility and when the content of the urea series compound is set to 10 wt % or lower, it is possible to prevent printing smearing.

3. ph Moderator

In the ink jet ink composite which can be used in combination with the pretreatment agent according to the embodiment of the invention, it is preferable to moderate pH to an alkali field by the pH moderator. In particular, when a desired pH value is greater than 9, it is preferable to moderate pH by organic amine. Although organic amine may be used without a particular limitation, it is preferable that alkanolamine having a comparatively low vapor pressure, particularly, triethanolamine is used.

4. Water

In the ink jet ink composite which can be used in combination with the pretreatment agent according to the embodiment of the invention, water may include arbitrary water, but it is preferable to use pure water. Pure water can be easily produced by ion exchange or distillation. In addition, it is more preferable to additionally sterilize pure water by ultraviolet ray.

5. Other Additives

The ink jet ink composite which can be used in combination with the pretreatment agent according to the embodiment of the invention may include alkylene glycol mono alkyl ether (i.e., triethylene glycol mono-n-butyl ether), a glycol compound (i.e., ethylene glycol, glycerine, or thiodiglycol)), pyrrolidone series compound (i.e., 2-pyrrolidone, or N-methyl-2-pyrrolidone), and/or surfactant (i.e., acethylene glycol series surfactant) so as to improve the ejection stability (in particular, ejection stability in a piezzo-head) of ink.

It is preferable that the ink jet ink composite which can be used in combination with the pretreatment agent according to the embodiment of the invention contains antiseptic in addition to the constituents described above. The preferable antiseptic, for example, may include proxel CRL, proxel BDN, proxel GXL, proxel XL-2, proxel IB, or proxel TN.

The ink jet ink composite which can be used in combination with the pretreatment agent according to the embodiment of the invention may include a chelate agent (a metal sequestering agent). The chelate agent is effective in improving reliability of ink by trapping the metal in ink and in preventing uneven dyeing by trapping a heavy metal in cloth. Ethylenediamine, tetraacetate salt, nitrilotriacetic salt, hexametaphosphate salt, pyrophosphate salt, or metaphosphate salt is very suitable as the chelate agent. TRILON TA and DEKOL SN marketed by BASF or Calgon T marketed by Benkiesed is excellent in biodegrability and is very suitable in terms of an environment.

The ink jet ink composite which can be used in combination with the pretreatment agent according to the embodiment of the invention contains some pertinently selected from the constituents, and the viscosity thereof is in the range of 8.0 mPa·s or lower and preferably in the range of 1.5 to 6.0 mpa·s, at 20° C. When the viscosity is in the range of 8.0 mPa or lower, it is possible to eject ink without a hindrance in a normal environmental temperature. Ink of which the viscosity is greater than 8.0 mPa·s at 20° C. becomes deteriorated in ejection stability in a low temperature area. The ink composite according to the embodiment of the invention has preferably a pH value of 10 or lower and more preferably a pH value of 7 to 9. When the pH value thereof is set to 10 or lower, it is possible to smearing and when it is set to 6 or higher, it is possible to obtain good solubility.

Ink Jet Printing Method

An ink jet printing method according to an embodiment of the invention primarily includes a process of ejecting and providing ink jet ink to cloth previously pretreated by the pretreatment agent according to the embodiment of the invention, a fixation process, and a washing process. In the processes described above, known methods and operations may be used. Hereinafter, specific embodiments of the processes will be exemplified.

Pretreatment Method

The method of attaching the pretreatment agent according to the embodiment of the invention to cloth preferably includes a coating method or a padding method in addition to a general method. For example, a contraction rate in padding can be pertinently determined by the thickness of cloth and/or the thickness of a fiber, and the contraction rate in padding is preferably 50% or higher and more preferably 65% or higher. Here, the contraction rate (S) can be calculated from the following Equation (1):

$$S\,(\%)=(A/B)\times 100 \qquad (1).$$

In Equation (1), 'S' indicates the contraction rate (%), 'A' indicates the amount of attached pretreatment agents, and 'B' indicates the weight of cloth.

When the contraction rate in padding is less than 50%, smearing prevention effect may be reduced and the coloring property may be deteriorated.

Cloth

Cloth which can be used in printing by the method according to the embodiment of the invention is not particularly limited as long as it is formed of a fiber which can printed by the acid dye. For example, cloth includes cloth formed of an animal fiber or a polyamide series fiber or cloth formed of a mixed fiber including at least one of the fibers. Preferably, the cloth includes cloth formed of silk or a polyamide series fiber.

Ink Jet Ejection

The ink jet printing method can be applied to arbitrary ink jet method such as a thermal method, a continuous method, or a piezzo method.

Fixation

The cloth treated by the pretreatment agent is fixed at high temperatureheat or by high-temperature steam after cloth is printed by the printing ink in accordance with the ink jet method. For example, it is possible to fix cloth by using a known steamer (DHe-type steamer manufactured by Matisse Corporation). It is preferable that the silk or the polyamide series fiber is treated in a saturated steam at 95 to 105° C. for 20 to 40 minutes as a fixing condition.

Washing

A washing operation is performed. Specifically, cloth is washed with running water and hot water is slowly added. Cloth is smeared in water of 50° C. in which nonionic surfactant is put for about 15 minutes while sometimes stirring. It is preferable that a bath ratio (the weight of a printing cloth/the weight of a bath) is 1/50. Cloth is washed by hand while putting the running water in washing fluid. It is possible obtain printing cloth by drying and ironing cloth after sufficiently washing cloth.

Embodiments

Hereinafter, the invention is specifically described according to embodiments of the invention, which do not limit the scope of the invention.

Embodiments 1 and 2

Comparative Examples 1 to 7, and Reference Examples 1 and 2

1. Preparation of Pretreatment Agents

Eleven kinds of pretreatment agents having compositions shown in Table 1 and Table 2 described below are prepared.

'HEC (SP200)' used for preparation of a pretreatment agent described in Embodiment 1 is hydroxyethyl cellulose (the weight-average molecular weight thereof is 120,000) produced by DAICEL CHEMICAL INDUSTRIES, LTD. and HEC (SP400) used for preparation of a pretreatment agent described in Embodiment 2 is hydroxyethyl cellulose (the weight-average molecular weight is 250,000) produced by DAICEL CHEMICAL INDUSTRIES, LTD.

'Sodium alginate' used for preparation of a pretreatment agent described in Comparative Example 1 is 'ULV-30' produced by Kimica Corporation and 'guar gum' used for preparation of a pretreatment agent described in Comparative Example 2 is 'maypro gum NP16' produced by Sansho Co., Ltd. 'Hydroxymethyl cellulose' used for preparation of a pretreatment described in Comparative 6 is '4850' produced by DAICEL CHEMICAL INDUSTRIES, LTD. In Table 1 and Table 2, numerical units are wt %.

TABLE 1

| | Embodiment 1 | Embodiment 2 | Comparative Example 1 | Comparative Example 2 | Comparative Example 3 | Comparative Example 4 | Comparative Example 5 |
|---|---|---|---|---|---|---|---|
| HEC (SP200) | 3 | | | | 0.5 | 3 | 3 |
| HEC (SP400) | | 2 | | | | | |
| Sodium alginate | | | 2 | | | | |

TABLE 1-continued

| | Embodiment 1 | Embodiment 2 | Comparative Example 1 | Comparative Example 2 | Comparative Example 3 | Comparative Example 4 | Comparative Example 5 |
|---|---|---|---|---|---|---|---|
| Guar gum | | | | 2 | | | |
| Urea | 10 | 10 | 10 | 10 | 10 | 10 | 10 |
| Ammonium sulfate | 4 | 4 | 4 | 4 | 4 | 0.5 | 7 |
| Water | 83 | 84 | 84 | 84 | 85.5 | 86.5 | 80 |
| Total | 100 | 100 | 100 | 100 | 100 | 100 | 100 |

TABLE 2

| | Comparative Example 6 | Comparative Example 7 | Reference Example 1 | Reference Example 2 |
|---|---|---|---|---|
| HEC (SP200) | | 8 | 3 | 3 |
| Hydroxymethyl cellulose | 2 | | | |
| Urea | 10 | 10 | 17 | 3 |
| Ammonium sulfate | 4 | 4 | 4 | 4 |
| Water | 84 | 78 | 76 | 90 |
| Total | 100 | 100 | 100 | 100 |

2. Preparation of Ink Composites

Five kinds of ink composites having compositions shown in FIG. 3 described below are prepared. In Table 3, CI acid black 52 is used in black ink (1) and black ink (2) and CI acid yellow 110 is used in yellow ink, CI acid red 289 is used in magenta ink, and CI acid blue 87 is used in cyan ink. Olefin E1010 is an acetylene glycol series surfactant. In Table 3, numerical units are wt %.

TABLE 3

| | Black Ink (1) | Black Ink (2) | Yellow Ink | Magenta Ink | Cyan Ink |
|---|---|---|---|---|---|
| Dye | 7.5 | 10 | 5.5 | 3.3 | 7.5 |
| Glycerine | 10 | 10 | 10 | 10 | 10 |
| Propylene glycol | 10 | 10 | 10 | 15 | 10 |
| Diethylene glycol-mono-butyl ether | 5 | 5 | 5 | 5 | 5 |
| Olefin E1010 | 1.1 | 1.1 | 1.1 | 1.1 | 1.1 |
| Triethanolamine | 0.5 | 0.5 | 0.5 | 0.5 | 0.5 |
| Pure water | 65.9 | 63.4 | 67.9 | 65.1 | 65.9 |
| Total | 100 | 100.0 | 100 | 100 | 100 |

3. Padding

The pretreatment agent prepared as described in the foregoing section 1 is padded to cloth using a padder (produced by Matisse Corporation). Silk of 12 monme is used as the cloth. The contraction rate thereof is about 75%. Since the pretreatment agent of Comparative Example 7 has a high viscosity, a padding speed markedly decreases. Accordingly, since the pretreatment agent of Comparative Example 7 may not be used, operations after the printing process are not performed.

4. Printing

Black ink (1), yellow ink, magenta ink, and cyan ink produced as described in the foregoing section 2 are injected into aluminum packs and are arranged in an ink jet printer (Printer MJ8000C manufactured by EPSON). A printing operation is performed on silk padded as described in the foregoing section 3 with these inks.

A thin black line and a black monochromatic solid color, a yellow monochromatic solid color, a magenta monochromatic solid color, a cyan monochromatic solid color, a secondary solid color composed of yellow and magenta, a secondary solid color composed of yellow and cyan, and a secondary solid color composed of magenta and cyan are used in a printing pattern.

5. Fixation

Printing cloth is fixed under a high humidity at 102° C. for 30 minutes and washed by a known method. Printing cloth ironed after washing is used as evaluation printing cloth.

6. Physical Property Evaluation: Printing Density

Optical density OD is measured. An optical density measuring apparatus (SPM50 manufactured by Gretag Macbeth) is used as a measuring apparatus. A light source is D50. The obtained results are shown in Table 4 and Table 5. In Table 4 and Table 5, 'OD-BK' means the OD value of the black monochromatic solid color, 'OD-Y' means the OD value of the yellow monochromatic solid color, 'OD-M' means the OD value of the magenta monochromatic solid color, and 'OD-C' means the OD value of the cyan monochromatic solid color. The obtained results are shown in Table 4 and Table 5.

7. Physical Property Evaluation: Secondary Color Smearing

Smearing of the secondary solid color composed of yellow and magenta, the secondary solid color composed of yellow and cyan, and the secondary solid color composed of magenta and cyan is functionally evaluated and categorized into five grades. The results are shown in Table 4 and Table 5. Evaluation grades are as follows:

A: All three secondary colors are not smeared

B: One secondary color is a little smeared

C: Two secondary colors are a little smeared

D: One secondary color is markedly smeared or three secondary colors are smeared a little E: Two or more secondary colors are markedly smeared 8. Physical Property Evaluation: Thin Black Line Smearing Smearing of the thin black line formed black ink (1) prepared as described in the foregoing section 2 is functionally evaluated for smearing and categorized into three grades. The obtained results are shown in Table 4 and Table 5. Evaluation grades are as follows:

A: Not smeared

B: A little smeared

C: Markedly smeared

9. Results of Physical Property Evaluation

TABLE 4

| | Embodiment 1 | Embodiment 2 | Comparative Example 1 | Comparative Example 2 | Comparative Example 3 | Comparative Example 4 | Comparative Example 5 |
|---|---|---|---|---|---|---|---|
| OD-BK | 1.5 | 15 | 1.3 | 1.4 | 1.3 | 0.8 | 1.3 |
| OD-Y | 1.4 | 1.4 | 1.2 | 1.3 | 1.2 | 0.8 | 1.3 |

TABLE 4-continued

| | Embodiment 1 | Embodiment 2 | Comparative Example 1 | Comparative Example 2 | Comparative Example 3 | Comparative Example 4 | Comparative Example 5 |
|---|---|---|---|---|---|---|---|
| OD-M | 1.4 | 1.4 | 1.2 | 1.3 | 1.3 | 0.7 | 1.2 |
| OD-C | 1.5 | 1.5 | 1.2 | 1.3 | 1.2 | 0.7 | 1.2 |
| Secondary color smearing | A | A | D | E | C | A | D |
| Thin black line smearing | A | A | A | B | B | A | A |

TABLE 5

| | Comparative Example 6 | Reference Example 1 | Reference Example 2 |
|---|---|---|---|
| OD-BK | 1.3 | 1.5 | 1.1 |
| OD-Y | 1.2 | 1.4 | 1.1 |
| OD-M | 1.2 | 1.4 | 1 |
| OD-C | 1.2 | 1.5 | 0.8 |
| Secondary color smearing | E | C | A |
| Thin black line smearing | A | B | A |

10. Analysis of Evaluation Result

As is known from comparison of Embodiment 1 and Comparative Example 3, when the content of hydroxyethyl cellulose is low, coloring density markedly decreases and smearing occurs. As shown in Comparative Example 7, when the content of hydroxyethyl cellulose is too high, the padding speed is markedly reduced and the ink composite is not practical.

As is known from comparison of Embodiment 1, Comparative Example 4, and Comparative Example 5, in the pretreatment agent according to the embodiment of the invention, the content of ammonium salt, particularly, the upper limit value is important. In other words, when the content of ammonium salt is low, an acid constituent is not sufficiently produced in steaming and the coloring density is markedly lowered (Comparative Example 4). Meanwhile, when the content of ammonium salt is greater than a certain level, smearing occurs for cyan in the secondary color composed of yellow and cyan and the secondary color composed of magenta and cyan (Comparative Example 5). In contrast, smearing does not occur in the printing method according to embodiment of the invention and the reason thereof is not clear.

As is known from comparison of Embodiments 1 and 2, and Comparative Examples 1, 2, and 6, when a water-soluble resin constituent except for hydroxyethyl cellulose is used, high coloring property may not be realized without occurrence of smearing.

Even in the embodiment of the invention, when the density of hydrotropic agent deviates from a normal density range, a bad effect occurs. As is known from comparison of Comparative Example 1 and Reference Example 1, when the content of urea is high, the thin black line is smeared and the secondary colors are also smeared. In contrast, as known from comparison of Embodiment 1 and Reference Example 2, when the content of urea is low, the coloring density is generally lowered.

Comparative Example 8

A black monochromatic solid pattern is printed onto silk cloth pretreated by the pretreatment agent of Comparative Example 2 shown in Table 1 in the same manner as in Embodiments 1 and 2 with black ink (2) having the composition shown in Table 3, the fixing treatment is performed and the printing density thereof is measured in the same manner as in Embodiments 1 and 2. Then, the OD value thereof is 1.5.

The inks such as black ink (1), black ink (2), yellow ink, magenta ink, and cyan ink shown in Table 3 are filled in the ink jet printer (Printer MJ8000C manufactured by EPSON) and a test of ejecting the inks to 2,000 pieces of A4 copy sheets is performed at 35° C.

Black ink (1), yellow ink, magenta ink, and cyan ink have good ejection performance to all A4 copy sheets. When the printing is performed again on the next morning after performing the printing operation to 2,000 pieces of copy sheets, they have the good ejection performance.

Meanwhile, a curve occurs slowly from an ejection start to the A4 copy sheets in black ink (2) and almost of half of the curve is accepted at the time of completing the printing of 200 pieces of copy sheets. 10% of nozzles are not ejected at the time of completing the printing of 500 pieces of copy sheets. When the printing is performed again on the next morning after it is left overnight, all the nozzles are not ejected.

Since black ink (2) has high dye density, it can obtain a high OD value, but lacks in suitability as ink jet ink.

For the ink jet printing method, when the density of the dye contained in an ink composition increases, it is possible to obtain a high coloring property without occurrence of smearing. However, since the ink composition containing the dye in high density increases in viscosity, ejection stability thereof decreases. Accordingly, there is a limit in the density of the dye contained in a usable ink composite. Under this condition, it becomes slowly difficult to obtain an OD value of a particular level or higher without occurrence of smearing.

However, surprisingly, even when an ink composite containing a dye of a density level generally in the known ink jet printing method is used for the pretreatment in accordance with the aspects of the invention, the occurrence is markedly suppressed. Accordingly, it is possible to obtain a very vivid high-quality image having the high coloring property. In other words, it is possible to realize the high coloring property exceeding a limit of the coloring property in the known ink jet printing method with marked reduction (i.e., realization of a marked vivid image) in occurrence of smearing.

Accordingly, when it is obtained an image having an OD value of a level equal to the level obtainable in the known ink jet printing method, it is possible to reduce an ink usage by the ink jet printing method according to the embodiment of the invention, whereby it is advantageous from the viewpoint of reduction in cost and environmental protection.

Smearing reduces and a high-quality image having a high coloring property can be obtained by using a pretreatment agent according to the embodiment of the invention is used in combination with ink jet ink containing the acid dye.

The entire disclosure of Japanese Patent Application No. 2006-74107, filed Mar. 17, 2006 is expressly incorporated by reference herein.

What is claimed is:

1. A pretreatment agent for pre-treating cloth comprising silk or a polyamide series fiber prior to the cloth being printed by ink jet printing with an ink composition comprising an acidic dye, the pretreatment agent comprising:

hydroxyethyl cellulose;

ammonium salt;

a hydrotropic agent which is urea; and water, wherein the weight-average molecular weight of the hydroxyethyl cellulose is in the range of 50,000 to 500,000, and wherein the hydroxyethyl cellulose is present in the pretreatment agent in a range of 1 to 5 wt %, the ammonium salt is present in an amount effective to improve color density of the acidic dye when the dye is printed on the cloth, said amount being in a range of 1 to 6 wt %, and the hydrotropic agent is present in a range of 8 to 12 wt %.

2. The pretreatment agent according to claim 1, wherein the ammonium salt is ammonium sulfate or ammonium tartrate.

3. A method comprising providing the pretreatment agent according to claim 1, and applying the pretreatment agent to treat silk or a polyamide series fiber.

4. Cloth comprising silk or a polyamide series fiber treated by the pretreatment agent according to claim 1.

5. The cloth according to claim 4, wherein the contraction rate of the pretreatment agent is 50% or higher.

6. An ink jet printing method, comprising the step of: ejecting ink jet ink containing an acidic dye onto the cloth according to claim 4.

7. The pretreatment agent according to claim 1 comprising the hydroxyethyl cellulose, ammonium salt and urea in respective amounts such that, when a cloth comprising silk or polyamide series fiber is pre-treated with the pretreatment agent and droplets of black, yellow, magenta and cyan inks comprising acid dyes are ejected onto the cloth from an inkjet printer to form print comprising a black monochromatic solid color, a yellow monochromatic solid color, a magenta monochromatic solid color, a cyan monochromatic solid color, and a plurality of secondary solid colors composed of the yellow and magenta, yellow and cyan and magenta and cyan inks, none of the plurality of secondary solid colors is smeared and each of the black, yellow, magenta and cyan monochromatic solid colors has an optical density of at least 1.4.

8. A kit comprising the pretreatment agent according to claim 7 and an ink set comprising the black, yellow, magenta and cyan inks comprising acid dyes.

9. The kit according to claim 8, further comprising a cloth comprising silk or a polyamide series fiber.

10. A method comprising providing the pretreatment agent according to claim 7, and applying the pretreatment agent to treat silk or a polyamide series fiber.

11. The pretreatment agent according to claim 1, wherein the urea is present in the pretreatment agent in an amount of up to 10 wt %.

* * * * *